US010029376B2

(12) United States Patent
Soucie et al.

(10) Patent No.: US 10,029,376 B2
(45) Date of Patent: Jul. 24, 2018

(54) ERGONOMIC CUTTING SHEARS

(71) Applicants: Dennis E. Soucie, Big Fork, MT (US); Gary A. White, Bigfork, MT (US)

(72) Inventors: Dennis E. Soucie, Big Fork, MT (US); Gary A. White, Bigfork, MT (US)

( * ) Notice: Subject to any disclaimer, the term of this patent is extended or adjusted under 35 U.S.C. 154(b) by 0 days.

(21) Appl. No.: 15/670,258

(22) Filed: Aug. 7, 2017

(65) Prior Publication Data

US 2017/0334078 A1 Nov. 23, 2017

Related U.S. Application Data

(63) Continuation of application No. 15/210,614, filed on Jul. 14, 2016, now Pat. No. 9,724,835, which is a continuation of application No. 13/526,977, filed on Jun. 19, 2012, now Pat. No. 9,421,690.

(60) Provisional application No. 61/572,884, filed on Jul. 25, 2011.

(51) Int. Cl.
*B26B 13/20* (2006.01)

(52) U.S. Cl.
CPC ..... *B26B 13/20* (2013.01)

(58) Field of Classification Search
CPC ..... B26B 13/20
USPC ..... 30/232, 256, 226, 230, 271, 341, 254, 30/257, 260, 194, 255; 403/408.1; 29/525.01
See application file for complete search history.

(56) References Cited

U.S. PATENT DOCUMENTS

| | | | | |
|---|---|---|---|---|
| 242,000 | A | | 5/1881 | Klaucke |
| 430,677 | A | | 6/1890 | Pearsall |
| 590,330 | A | | 9/1897 | Nolen |
| 753,919 | A | | 3/1904 | Rowe |
| 927,058 | A | | 7/1909 | Krouse |
| 1,479,908 | A | | 1/1924 | Goshia |
| 2,158,277 | A | | 5/1939 | Dolph |
| 2,571,675 | A | | 10/1951 | Bray |
| 2,744,324 | A | | 5/1956 | Chuba |
| 2,893,347 | A | | 7/1959 | Freiberg |
| 4,146,961 | A | * | 4/1979 | Pinto ..... B26B 13/20 30/271 |
| 4,642,895 | A | | 2/1987 | Gauvry |
| 4,742,617 | A | | 5/1988 | Gauvry |
| 5,060,381 | A | | 10/1991 | Taberlet |
| 5,469,624 | A | | 11/1995 | Brenton et al. |
| 6,212,780 | B1 | | 4/2001 | Huang |
| 6,249,977 | B1 | | 6/2001 | Knoop |
| 6,915,578 | B2 | | 7/2005 | Yusufov et al. |
| D536,941 | S | | 2/2007 | Nenadich et al. |

(Continued)

FOREIGN PATENT DOCUMENTS

| | | | |
|---|---|---|---|
| GB | 1370758 | A | 4/1972 |

*Primary Examiner* — Ghassem Alie

(74) *Attorney, Agent, or Firm* — Haffey Vap PLLC; Mitchell J. W. Vap

(57) ABSTRACT

A pair of scissors has a first cutting blade with a thumb handle and a thumb ring and a second cutting blade with a finger ring. The second cutting blade is pivotally attached to the first cutting blade, and the first and second cutting blades pivot relative to one another within a first plane. The thumb ring is slidably attached to the first cutting blade by a shaft that moves freely but with a certain amount of friction along a longitudinal slot in the thumb handle of the first cutting blade when the scissors are in use. The longitudinal slot in the thumb handle is situated within a second plane that is perpendicular to the first plane.

2 Claims, 8 Drawing Sheets

(56) References Cited

U.S. PATENT DOCUMENTS

| | | | |
|---|---|---|---|
| D537,312 | S | 2/2007 | Nenadich et al. |
| D538,612 | S | 3/2007 | Nenadich et al. |
| 7,424,778 | B2 | 9/2008 | Brenton |
| 7,966,733 | B2 | 6/2011 | Jun |
| 2004/0211068 | A1 | 10/2004 | Yusufov et al. |
| 2005/0204569 | A1 | 9/2005 | Brenton |
| 2006/0010695 | A1 | 1/2006 | Wu |
| 2006/0064879 | A1 | 3/2006 | Lauritzen et al. |
| 2008/0172886 | A1 | 7/2008 | Jun |
| 2010/0192384 | A1 | 8/2010 | Fox |
| 2010/0212165 | A1 | 8/2010 | Pamazzini et al. |
| 2010/0242289 | A1 | 9/2010 | Roskam et al. |
| 2011/0016728 | A1 | 1/2011 | Hann et al. |

* cited by examiner

ERGONOMIC CUTTING SHEARS

CROSS-REFERENCE TO RELATED APPLICATIONS

This application is a continuation of U.S. patent application Ser. No. 15/210,614, filed Jul. 14, 2016, which is a continuation of U.S. patent application Ser. No. 13/526,977, filed Jun. 19, 2012, now U.S. Pat. No. 9,421,690, issued Aug. 23, 2016, which claims the benefits of U.S. Provisional Application No. 61/572,884, filed Jul. 25, 2011, the disclosures of which are hereby incorporated by reference in their entirety including all figures, tables and drawings.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

1. Field of the Invention

The present invention relates generally to the field of cutting shears, and more specifically, to cutting shears with a longitudinally slidable and preferably rotatable thumb ring that moves ergonomically with the thumb during use.

2. Description of the Related Art

There are a number of cutting shears incorporating longitudinally and/or rotationally adjustable thumb and finger rings that are the subject of issued patents or published patent applications, but none of these inventions includes the novel features of the present invention, most notable a thumb ring that is readily slidable back and forth in the longitudinal direction and readily pivotable for a comfortable thumb angle during use of the scissors, while in addition, the thumb ring is automatically restrained in its last position when the thumb is temporarily removed from the ring.

U.S. Pat. No. 1,479,908 (Goshia, 1924) discloses scissors with an automatically adjustable thumb ring that is connected to the shank of the scissors via a rivet pin fitted with a friction roller. The thumb ring is designed to slide forward and backward on the shank (i.e., the handle) with each opening and closing of the scissors. The thumb ring may be optionally locked in place with a set screw. There is no provision in this invention for automatic restraint of the ring when the thumb is removed from the ring.

U.S. Pat. No. 2,158,277 (Dolph, 1939) provides scissors with a manually adjustable thumb ring, which may be set to any one of a number of discreet positions along the shaft. The discreet positions are determined by a set of teeth along the shaft that mate with a set of matching teeth on the thumb ring.

U.S. Pat. No. 2,571,675 (Bray, 1951) describes scissors with removable thumb and finger rings, in which the thumb ring may be longitudinally adjusted and locked into position prior to use, and in which the diameters of the thumb and finger rings may be adjusted to fit hands of various sizes.

U.S. Pat. No. 4,642,895 (Gauvry, 1987) discloses scissors having a thumb loop that is rotatable longitudinally along and perpendicularly around the axis of the scissors handle by means of a ball and socket interconnection. The invention also comprises a rubber stop or bumper to limit the closing of the blades. In this invention, the thumb loop does not slide freely along the longitudinal axis of the handle; instead, it only rotates around the ball and socket joint.

U.S. Pat. No. 5,469,624 (Benton et al.) provides scissors and similar instruments that comprise interchangeable, rotatable and pivotable thumb and finger rings that incorporate a hand-adjustable tensioning means. The rings are not capable of sliding longitudinally along the handle.

U.S. Pat. No. 6,212,780 (Huang, 2001) describes scissors and similar instruments that comprise a thumb ring that may be adjusted longitudinally along the handle and set a discrete points prior to use, using a cam lock or screw as a locking means.

U.S. Pat. No. 6,249,977 (Knopp, 2001) discloses scissors having a T-shaped finger grip and a thumb ring grip, in which each of the two grips can be adjusted longitudinally along a handle and secured at the desired position with a locking screw.

U.S. Pat. No. 6,915,578 (Yusufov et al., 2005) and U.S. Patent Application Publ No. 2004/0211068 (Yusufov et al, 2004) provide a reversible-blade scissors comprising finger and thumb rings that are longitudinally and pivotable adjustable. Each ring is secured both longitudinally and pivotably by a single thumb screw prior to use of the scissors. The shafts of the thumbs screws are fitted into longitudinal slots, (i.e., tracks), in which the tracks are within flat sides of the handles, and the flat sides of the handles are in the same plane as the flat sides of the blades.

U.S. Pat. No. 7,424,778 (Benton, 2008) and U.S. Patent Application Pub. No. 2005/0204569 (Benton, 2005) describe scissors having a pivotable adjustable thumb ring, wherein the pivot shaft is made of flexible material, thereby allowing the ring to flex as well as pivot. There is no longitudinal adjustment of the thumb ring in this invention.

U.S. Pat. No. 7,966,733 (June, 2011) and U.S. Patent Application Pub. No. 2008/0172886 (June, 2008) disclose scissors comprising a thumb ring that is capable of rotating in two independent directions and pivoting around one axis that is parallel to the handle. The thumb ring of this invention is not capable of longitudinal adjustment.

U.S. Patent Application Pub. No. US 2006/0010695 (Wu, 2006) provides thumb and finger rings for scissors that are rotatable and detachable. There is no provision for longitudinal adjustment of the rings in this invention.

U.S. Patent Application Pub. No. US 2010/0192384 (Fox, 2010) describes shears having a pivotable and flexible finger ring. There is no provision for longitudinal adjustment of the ring in this invention.

U.S. Patent Application Pub. No. US 2010/0212165 (Parnazzina et al., 2010) discloses scissors with a pivotable thumb ring and saw-toothed edges on the blades. There is no provision for longitudinal thumb ring adjustment in this invention.

U.S. Patent Application Pub. No. US 2010/0242289 (Roskam et al., 2010) provides scissors comprising an articulated thumb ring that is magnetically attached to the handle. The thumb ring may be detached and reattached to the handle during use of the scissors without removing the ring from the thumb.

U.S. Patent Application Pub. No. US 2011/0016728 describes a scissors with thumb ring that is adjustable for offset, rotation, and diameter. There is no provision for longitudinal adjustment of the thumb ring in this invention.

U.S. Patent No. D536,941 (Nenadich et al, 2007), U.S. Pat. No. D537,312 (Nenadich et al., 2007), and U.S. Design Pat. No. D538,612 (Nenadich et al, 2007) illustrate scissors having pivotable (but not longitudinally adjustable) thumb rings.

BRIEF SUMMARY OF THE INVENTION

The present invention is a pair of scissors comprising: a first cutting blade comprising a thumb handle and a thumb ring; a second cutting blade comprising a finger ring, wherein the second cutting blade is pivotally attached to the first cutting blade, and wherein the first and second cutting blades pivot relative to one another within a first plane that is defined by a first axis and a second axis; wherein the thumb ring is slidably attached to the first cutting blade by a shaft that moves freely but with a certain amount of friction along a longitudinal slot in the thumb handle of the first cutting blade when the scissors are in use; and wherein the longitudinal slot in the thumb handle is situated within a second plane that is defined by the first axis and a third axis that is perpendicular to the first and second axes so that the second plane is perpendicular to the first plane.

In a preferred embodiment, the invention further comprises a tensioning washer, a lower slide washer, and an upper slide washer; wherein the thumb handle comprises an upper surface and a lower surface; wherein the tensioning washer is situated between the thumb ring and the lower slide washer, the lower slide washer is situated between the tensioning washer and the lower surface of the thumb handle, and the upper slide washer is situated adjacent to the upper surface of the thumb handle directly above the longitudinal slot; wherein the shaft extends through the upper slide washer, the longitudinal slot in the thumb handle, the lower slide washer, and the tensioning washer; and wherein the shaft is connected to the thumb ring.

In an alternate embodiment, the invention further comprises a micro thrust bearing and an upper slide washer; wherein the thumb handle comprises an upper surface and lower surface; wherein the micro thrust bearing is situated between the thumb ring and the lower surface of the thumb handle, and the upper slide washer is situated adjacent to the upper surface of the thumb handle directly above the longitudinal slot; wherein the shaft extends through the upper slide washer, the longitudinal slot in the thumb handle, and the micro thrust bearing; and wherein the shaft is connected to the thumb ring.

In yet another alternate embodiment, the invention further comprises a magnet, a lower slide washer and an upper slide washer; wherein the thumb handle comprises an upper surface and a lower surface; wherein the magnet is situated between the thumb ring and the lower slide washer, the lower slide washer is situated between the magnet and the lower surface of the thumb handle, and the upper slide washer is situated adjacent to the upper surface of the thumb handle directly above the longitudinal slot; wherein the shaft extends through the upper slide washer, the longitudinal slot in the thumb handle, the lower slide washer, and the magnet; and wherein the shaft is connected to the thumb ring.

In a preferred embodiment, the thumb ring rotates relative to the longitudinal slot. In an alternate embodiment, the shaft comprises a square portion that is configured to fit within the longitudinal slot in the thumb ring and that prevents the thumb ring from rotating relative to the longitudinal slot. In yet another alternate embodiment, the invention is a pair of scissors comprising; a first cutting blade comprising a thumb handle and a thumb ring; and a second cutting blade comprising a finger ring, wherein the second cutting blade is pivotally attached to the first cutting blade; wherein the thumb ring is slidable attached to the first cutting blade by a shaft that moves freely but with a certain amount of friction along a longitudinal slot in the thumb handle of the first cutting blade when the scissors are in use; and wherein each of the first and second cutting blades comprises two flat sides, that thumb handle comprises two sliding surfaces, and the sliding surfaces of the thumb handle are perpendicular to the flat sides of the cutting blades.

REFERENCE NUMBERS

Figure 1:
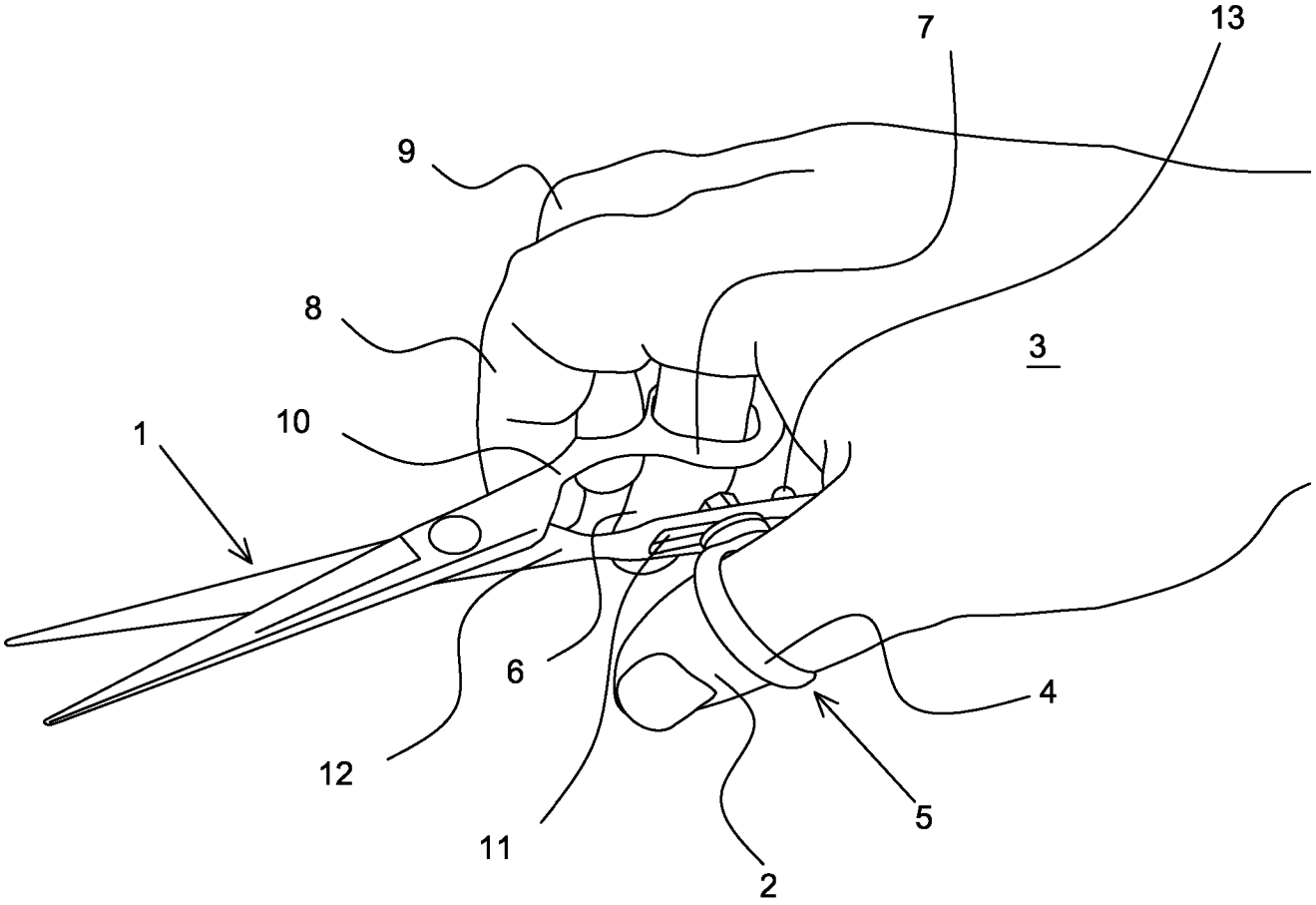
FIG. 1 is a perspective view of the first embodiment of the present invention, showing a user's fingers inserted into the thumb and finger rings of the scissors.

1 Scissors
2 Thumb

3 Hand
4 Thumb ring
5 Thumb ring assembly, first embodiment
6 Third finger
7 Finger ring
8 First finger
9 Second Finger
10 Finger handle
11 Adjustment slot
12 Thumb handle
13 Bumper
14 Lower standard washer
15 Tensioning washer
16 Lower slide washer
17 Upper slide washer
18 Upper standard washer
19 Screw
20 Arrow indicating longitudinal movement
21 Arrow indicating rotational movement
22 Thumb ring assembly, second embodiment
23 Micro thrust bearing
24 Thumb ring assembly, third embodiment
25 Thumb ring with integral threaded shaft
26 Integral threaded shaft
27 Spacer
28 Magnet
29 Nut
30 Thumb ring assembly, first embodiment (modified to incorporate threaded shaft)
31 Magnet with square center hole
32 Threaded shaft with square (non-threaded) center portion
33 Lower slide washer with square center hole
34 Upper slide washer with square center hole
35 Blades of scissors

DETAILED DESCRIPTION OF THE INVENTION

The present invention is cutting shears or scissors that incorporate a multiply adjustable thumb ring. As used herein, the terms "shear," "cutting shears" and "scissors" are used interchangeably. Modes of adjustment of the thumb ring include adjustment of the longitudinal position of the thumb ring along the length of the handle and adjustment of the angular orientation of the thumb ring around an axis that is perpendicular to the long axis of the handle. Each mode of adjustment can be accomplished with the cutting hand without removing the thumb from the thumb ring or the finger from the finger ring. The ability to adjust the scissors as needed for a particular cutting operation and to adjust the scissors to fit the user's hand size and shape is important for reducing fatigue and for minimizing repetitive-motion injuries.

The ability to quickly and easily slide the thumb ring longitudinally along the sliding surfaces (i.e., the upper and lower surfaces) of the thumb handle is particularly useful for cutting hair. For example, when the thumb ring is slid forward (toward the blades), the cutting strokes are more precise, which is useful for making delicate and high-precision cuts around the eyes and ears. Conversely, when the thumb ring is slid rearward, more force can be applied to the blades, which is useful for making fast cuts on non-critical areas, such as initial cropping of long hair. During haircutting, the hairdresser or barber typically switches from using scissors to using a comb multiple times; therefore, it is highly beneficial for the scissors thumb ring to remain in place when the thumb is temporarily removed from the ring for combing, etc. because the thumb can then be easily reinserted into the ring without minimal loss of time or energy. In a similar manner, it is beneficial for the rotational position of the thumb ring to remain fixed when the thumb is temporarily removed from the ring. The present invention is superior to the prior art because the adjustments of the thumb ring are easily and quickly made with the user's thumb and finger inserted into the rings of the scissors handles, and the adjustments maintain their positions until they are purposely readjusted. None of the inventions of the prior art has this capability.

The materials and design of the present invention are purposely optimized to provide low friction when longitudinal or rotational adjustments are desired, but they also provide adequate friction to hold the desired position of the thumb ring when movement is not desired. There are three major embodiments of the present invention. Different thumb ring assembly components are used in each of the three embodiments to provide controlled friction for the adjustable thumb ring. All of the embodiments comprise identical handles in which the sliding surfaces of the thumb handle are perpendicular to the flat sides of the scissors blades. Each thumb handles incorporates a longitudinal slot through which the thumb ring components are attached. The present invention may be used in combination with most types of conventional scissors by installing a slot in the thumb handle of the scissors. The slot provided a track for the moving components. The sliding surfaces of the thumb handle are highly polished to eliminate undesired friction.

In the first embodiment, the thumb ring is attached to the handle by a screw that passes through the handle slot. (As used in the claims, the term "shaft" is intended to encompass the shaft of a screw.) Several washers are mounted on the screw. These washers include low-friction slide washers installed on each side of the handle and in contact with the polished faces of the handle, one rubber tensioning washer and standard metal washers in contact with the thumb ring and the underside of the screw head. The slide washers are preferably made of polytetrafluoroethylene (PTFE; e.g., trade name TEFLON™), plastic or other slide-enhancing materials. The tensioning washer is preferably made of a compressible synthetic rubber such as neoprene or nitrile having durometer hardness in the range of about 40A to 80A. The tensioning washer preferably has an uncompressed thickness of about 0.1 to 0.2 inch. During assembly, the screw is threaded into a threaded hold in the base of the thumb ring until the tensioning washer is compressed sufficiently to provided proper sliding and rotational friction for the thumb ring.

The second embodiment is similar to the first embodiment, except that the lower slide washer and tensioning washer of the first embodiment are replaced with a micro thrust bearing. The thrust bearing provides a very low-friction contact with the outside surface of the handle, while the required friction for the assembly is supplied by the slide washer in contact with the inside surface of the handle. The micro thrust bearing may be any suitable commercial product, such as part number 6655K12 from McMaster-Carr Supply Company of Aurora, Ohio. The latter part has steel ball bearings and an outside diameter of 0.5 inch, although the present invention is not limited to any particular outside diameter of the micro thrust bearing. The micro thrust bearing a preferably comprised of a ring in which ball bearings are embedded. The ring of the micro thrust bearing may be comprised of any suitable material, for example, plastic or nylon, and the ball bearings may be comprised of any suitable material, for example, steel or ceramic.

The third embodiment is similar to the first embodiment except that the tensioning washer is replaced by a cylindrical magnet. In this embodiment, friction between the outside slide washer and the contact surface of the handle is provided by a compression force resulting from the magnetic attraction between the magnet and the handle. For the third embodiment, the handle must be made of a metal material, such as stainless steel or chrome-plated carbon steel, that attracts magnets. Rare earth magnets, which have strong magnetic field compared to iron magnets of the same size, are preferable for this invention because they are lighter and smaller than comparable-strength iron magnets.

It is possible to combine the features of two or more of the three embodiments to form a hybrid configuration. For example, the thumb ring assembly may comprise a micro thrust bearing (from the second embodiment) on one or both contact surfaced of the thumb handle in combination with a magnet (from the third embodiment) on one side of the handle.

The present invention preferably incorporates a polymer bumper mounted on the inner surface of one handle. This bumper contacts the inner surface of the opposing handle when the scissors are fully closed. The purpose of the bumper is to set the position of the blades relative to each other when the scissors are fully closed and to minimize wear that would otherwise occur if the hard inner surfaces of the handles came into direct contact during closing of the scissors. The bumper may optionally be placed either forward of the thumb ring (i.e., closer to the blades) or rearward of the thumb ring. Each of the embodiments of the present invention will operate correctly with either a forward-mounted or rearward-mounted bumper.

Each of the three embodiments comprises a threaded shaft that passes through the slot of the thumb handle and slides back and forth within the slot to provide longitudinal adjustment of the thumb ring. The threaded shaft may optionally be manufactured either as an integral piece of the ring component, or alternately, it may be a separate screw component or non-integral threaded shaft that threads into the ring component. The configuration of the threaded shaft (integral threaded shaft, non-integral threaded shaft or separate screw) does not affect the operation of the invention.

Figure 11:
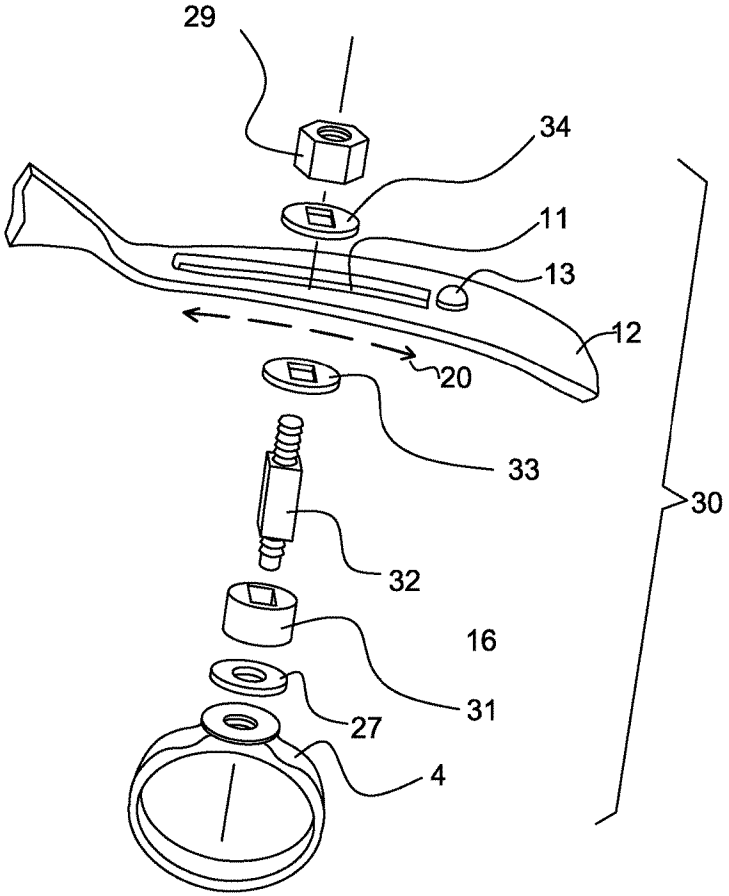
FIG. 11 is an exploded perspective view of the embodiment shown in FIG. 10.
Figure 10:
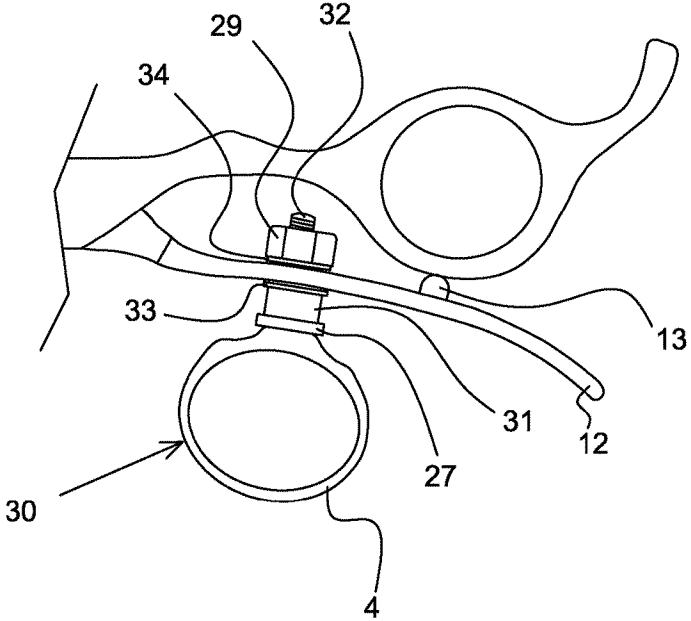
FIG. 10 is a side view of an alternate embodiment of the present invention comprising a shaft with a square portion that allows the rotational orientation of the thumb ring 4 to be preset and locked prior to use.

Each of the three embodiments may optionally comprise a threaded shaft with a square (non-threaded) center portion in lieu of a fully threaded shaft. The purpose of the square portion is to prevent rotational movement of the thumb ring. In this configuration, the angle of the thumb ring is preset and locked into position prior to use, while longitudinal movement is still permitted. The fixed rotational option may be preferred by some users. This embodiment is shown in FIGS. 10 and 11. As used herein, the term "square" is intended to also encompass rectangular.

FIG. 1 is a perspective view of scissors that incorporate the first embodiment of the present invention, shown with a user's fingers inserted into the thumb and finger rings of the scissors. Referring to FIG. 1, the scissors 1 are grasped so the thumb 2 of the user's hand 3 is inserted into the thumb ring 4 of the first embodiment of the thumb ring assembly 5, while the third finger 6 is inserted into the finger ring 7, and the first finger 8 and second finger 9 are rested along the outer surface of the finger handle 10. Also shown in FIG. 1 is the longitudinal adjustment slot 11 in thumb handle 12 and scissors bumper 13. As shown in the figure, the thumb ring assembly 5 is positioned at an intermediate position within the slot 11 (i.e., the thumb ring 5 assembly is rearward of the front edge of the slot 11).

Figure 2:
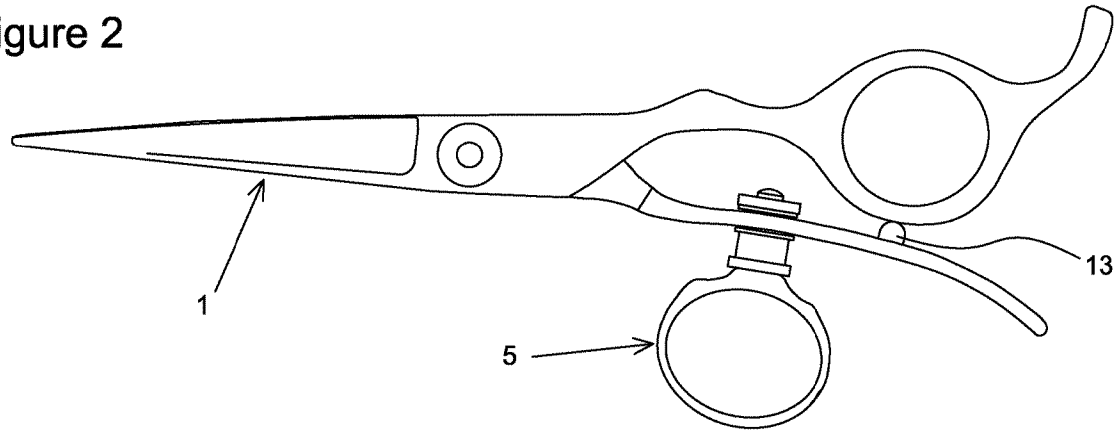
FIG. 2 is a side view of the first embodiment of the present invention, in which the scissors bumper is installed rearward of the thumb ring.
Figure 3:
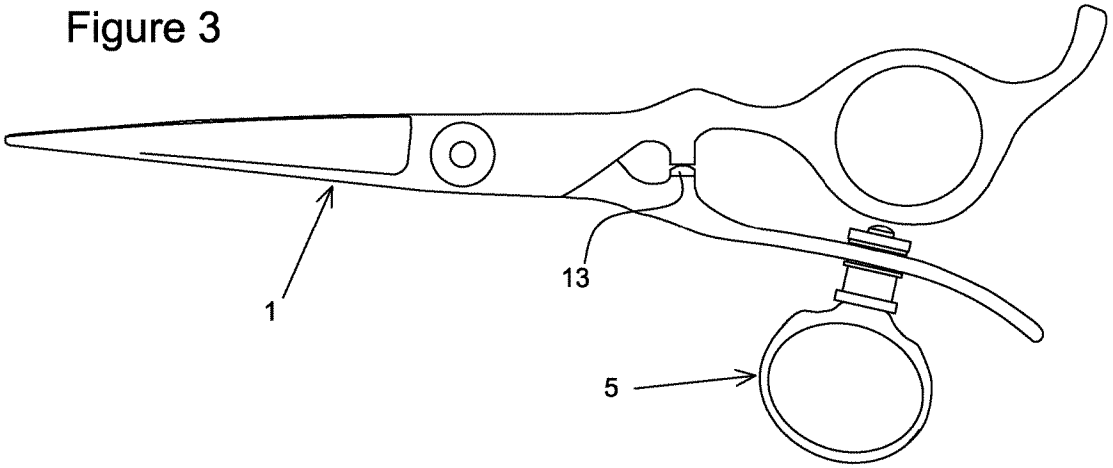
FIG. 3 is a side view of an alternative embodiment of the present invention, in which the scissors bumper is installed forward of the thumb ring.

FIG. 2 is a side view of the embodiment shown in FIG. 1, in which the scissors bumper 13 is installed rearward of the thumb ring assembly 5. FIG. 3 is a side view of an alternate embodiment of the present invention, in which the scissors bumper 13 is installed forward of the thumb ring assembly 5. Note that in the embodiment shown in FIG. 3, the thumb ring may slide all the way to the rear of the longitudinal slot (not shown) with the scissors in a fully closed position. FIGS. 2 and 3 illustrate that the present invention is equally compatible with scissors having either a rearward- or forward-mounted bumper.

Figure 5:
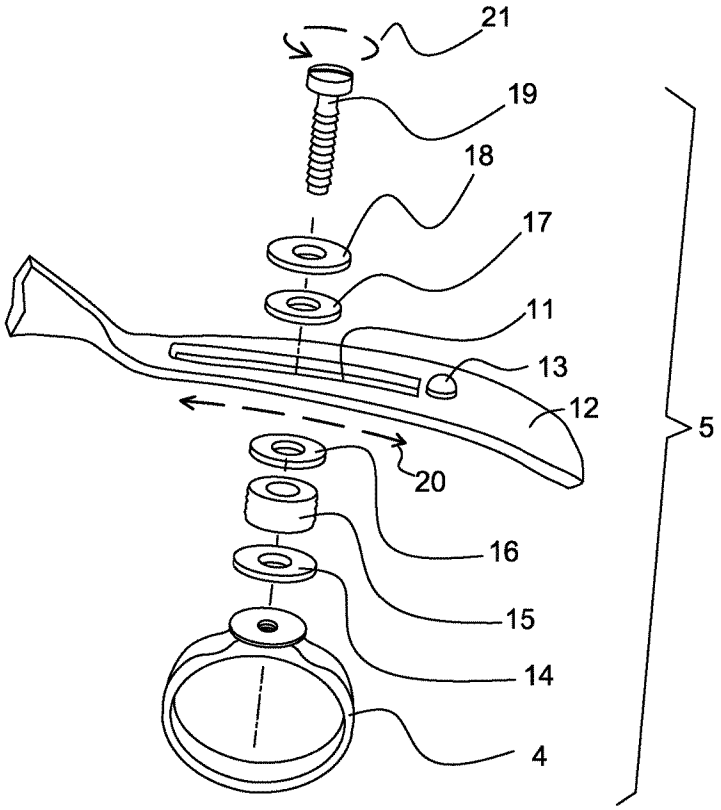
FIG. 5 is an exploded perspective view of the first embodiment of the present invention including the thumb ring assembly and a portion of the thumb handle.
Figure 4:
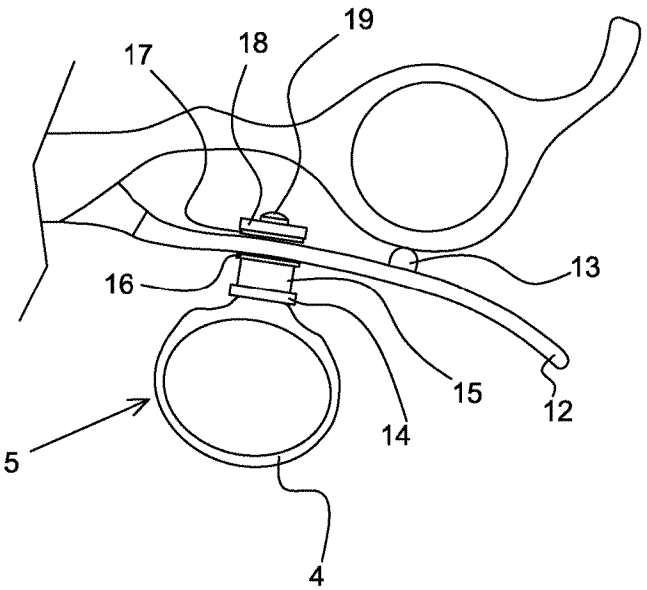
FIG. 4 is a side view of the first embodiment of the present invention including the thumb ring assembly and a portion of the thumb handle.

FIG. 4 is a side view of the first embodiment of the present invention that shows the ring assembly 5 installed on the thumb handle 12. FIG. 5 is an exploded perspective view of the thumb ring assembly of the first embodiment. As shown in FIGS. 4 and 5, components of the thumb ring assembly 5 include the thumb ring 4, lower standard washer 14, tensioning washer 15, lower slide washer 16, upper slide washer 17, upper standard washer 18, and screw 19. During assembly of the thumb ring assembly 5 to the thumb handle 12, the screw 19 is passed through the adjustment slot 11 and then screwed into the threaded portion of the thumb ring 4. The screw 19 is tightened until the tensioning washer 15 is partially compressed. The compression of the tensioning washer 15 produces friction between the lower slide washer 16 and the lower contacting surface of the thumb handle 12 and friction between the upper slide washer 17 and the upper contacting surface of the thumb handle 12.

The compression of the tensioning washer 15 is increased by tightening the screw 19 until the resistance of the thumb ring 4 against rotational and longitudinal movement is at the correct level. The arrow 20 shown in FIG. 5 indicates the direction of longitudinal movement of the thumb ring assembly 5, and the arrow 21 indicates the direction of rotational movement of the thumb ring assembly 5 relative to the thumb handle 12. As previously described, the correct level of friction is preferably low enough to allow the user to adjust the longitudinal and rotational position of the thumb ring 4 when the thumb 2 is positioned within the thumb ring 4, while at the same time the friction level is great enough to cause the thumb ring 4 to stay in the set longitudinal and rotational positions when the thumb 2 is removed from the thumb ring 4.

Figure 14:
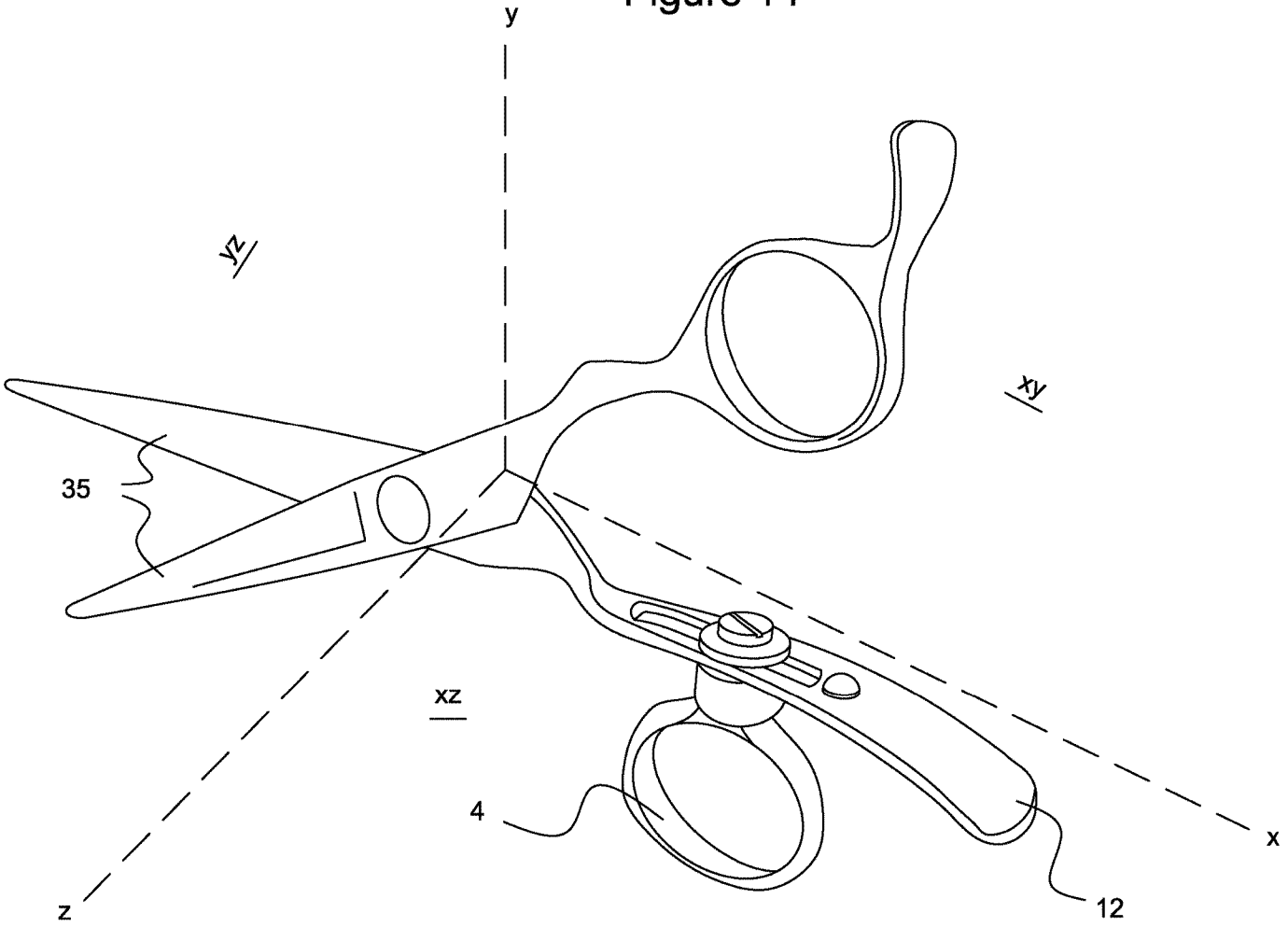
FIG. 14 is a perspective view of the first embodiment of the present invention, illustrating the planar relationship between the cutting blades and thumb handle.

As shown in FIG. 14, the cutting shears pivot about an x and a y axis in a two-dimensional plane, whereas the longitudinal slot lies with in a z axis that is perpendicular to the x and the y axes. This orientation of the longitudinal slot is important to the present invention because it enables the shaft 19, 26, 31 to move more freely within the longitudinal slot then the slot of Yusufov, for example, which is oriented solely within the x-y plane. The shaft of Yusufov is not intended to move freely during use of the scissors.

Figure 7:
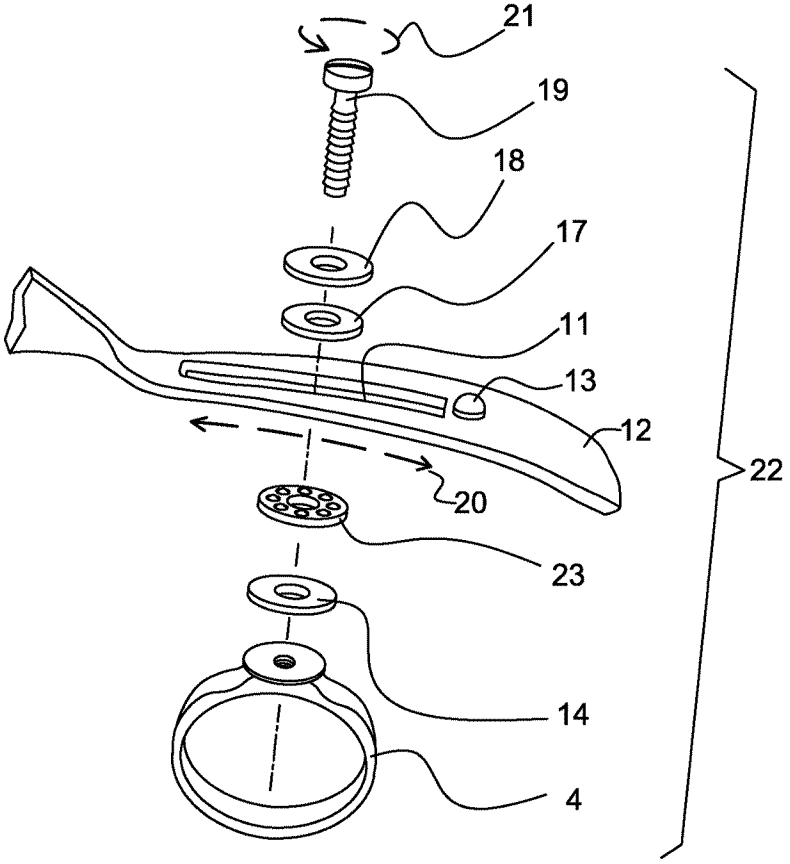
FIG. 7 is an exploded perspective view of the second embodiment of the present invention including the thumb ring assembly and a portion of the thumb handle.
Figure 6:
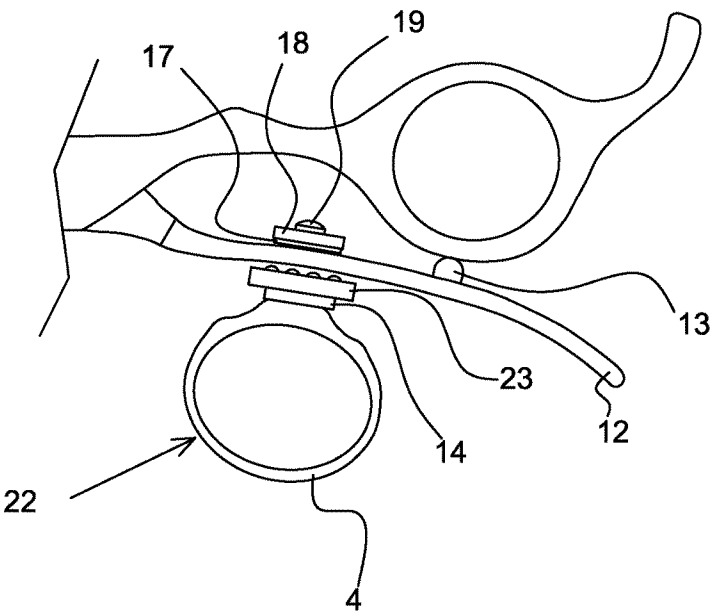
FIG. 6 is a side view of the second embodiment of the present invention including the thumb ring assemble and a portion of the thumb handle.

FIG. 6 is a side view of the second embodiment of the present invention that shows the ring assembly (second embodiment) 22 installed on the thumb handle 12. FIG. 7 is an exploded perspective view of the thumb ring assembly 22 of the second embodiment. As shown in FIGS. 6 and 7, the thumb ring assembly 22 of the second embodiment comprises a thumb ring 4, a lower standard washer 14, a micro thrust bearing 23, and upper slide washer 17, and upper standard washer 18, and a screw 19. In the second embodiment, the components of the thumb ring assembly shown in FIGS. 6 and 7 are connected to the thumb handle 12 by passing the screw 19 through the adjustment slot 11 and then tightening the screw 19 until the proper level of friction is achieved against longitudinal and rotational movement of the thumb ring 4.

Figure 9:
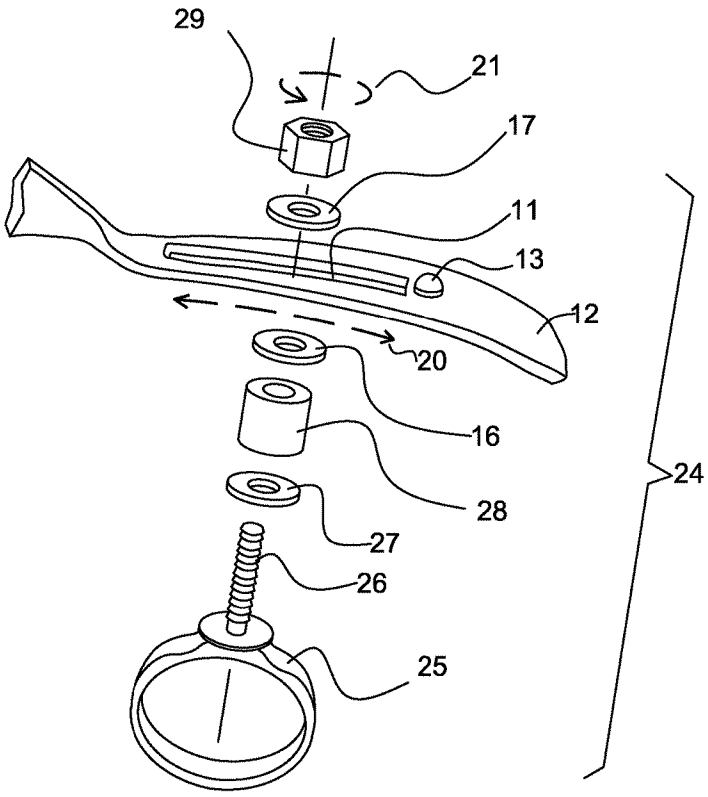
FIG. 9 is an exploded perspective view of the third embodiment of the present invention including the thumb ring assembly and a portion of the thumb handle.
Figure 8:
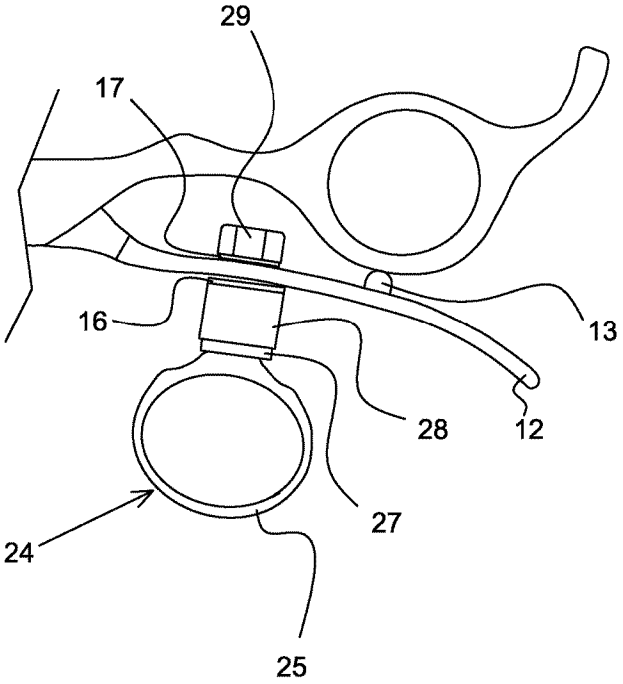
FIG. 8 is a side view of the third embodiment of the present invention including the thumb ring assemble and a portion of the thumb handle.

FIG. 8 is a side view of the third embodiment of the present invention that shows the ring assembly (third embodiment) 24 installed on the thumb handle 12. FIG. 9 is an exploded perspective view of the thumb ring assembly 24 of the third embodiment. As shown in FIGS. 8 and 9, the thumb ring assembly 24 of the third embodiment comprises a thumb ring 25 with integral threaded shaft 26, a spacer 27, a magnet 28, a lower slide washer 16, and upper slide washer 17, and a nut 29. In the third embodiment, the thumb ring assembly 24 is assembled to the thumb handle 12 by passing the integral threaded shaft 26 through the adjustment slot 11 and threading the nut 29 onto the threaded shaft 26. The tightening tension of the nut 29 is not critical in this embodiment because friction is supplied by the force of the magnet toward the thumb handle 12, which pushes the lower slide washer 16 against the lower contact surface of the thumb handle 12. The proper level of friction against longitudinal and rotational movement in this embodiment is set by adjusting the size of the magnet 28. For example, installing a longer magnet, or a second identical magnet, will increase the friction of the thumb ring 25. Although one or two magnets is/are preferred, the present invention is not limited to any particular number of magnets.

Although this first and second embodiments are shown with a screw 19, and the third embodiment is shown with an integral threaded shaft 26, any of the three embodiments could be made with a non-integral threaded shaft (similar to be partially threaded shaft 31 and nut 29 shown in FIG. 11).

FIGS. 10 and 11 illustrate an optional feature that may be incorporated into any of the three embodiments previously described and is particularly shown here used with a modified form of the third embodiment. FIG. 10 is a side view of the modified third embodiment of the present invention 30 that allows the rotational orientation of the thumb ring 4 to be preset and locked prior to use. FIG. 11 is an exploded perspective view of the embodiment shown in FIG. 10.

As shown in FIG. 11, the modified thumb ring assembly of the third embodiment 30 is comprised of a thumb ring 4, a spacer 27, a magnet with a square central hole 31, a threaded shaft with a central (non-threaded) square portion 32, a lower slide washer with a square central hole 33, and upper slide washer with a square central hole 34, and a nut 29. (Note that the magnet 31 could also be made with a round central hole if the central (non-threaded) square portion 32 of the threaded shaft were shorter.) The shaft 32 has threads on the lower end that thread into the thumb ring 4 and threads on the upper end that thread into the nut 29. The square portion of the shaft 32 is sized so as to fit snugly but movably in the side and against the sides of the slot 11, thereby allowing the shaft 32 to slide longitudinally along the length of slot 11 but preventing it from rotating with in the slot 11. By this means, when the modified thumb ring assembly 30 is installed on the thumb handle 12, the thumb ring assembly 30 is free to slide back and forth in the longitudinal direction as shown by the arrow 20 but is restrained from rotational movement. The shaft shown in FIGS. 10 and 11 can be used with the tensioning washer of the first embodiment or the micro thrust bearing of the second embodiment, as long as these components have a square central hole.

Figure 12:
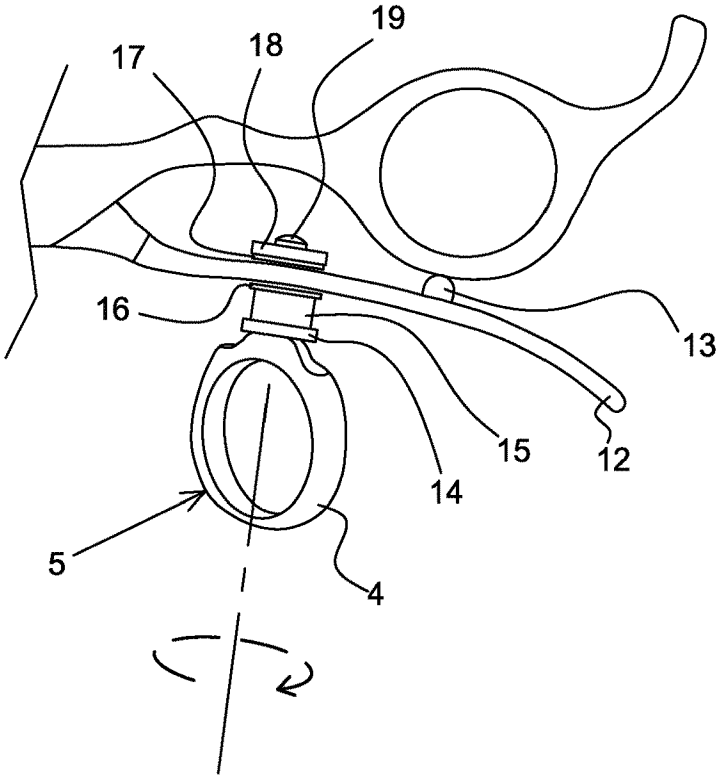
FIG. 12 is a side view of the first embodiment of the present invention that shows the thumb ring rotated approximately forty-five (45) degrees as compared to the view shown in FIG. 4.

FIG. 12 is a side view of the first embodiments of the present invention that shows the thumb ring rotated approximately forty-five (45) degrees as compared to the view shown in FIG. 4. The direction of rotational movement is indicated by the dashed arrow. The thumb ring is free to rotate during each opening and closing of the scissor blades during use, thereby allowing the thumb orientation to constantly adjust to an optimal position for comfort and efficiency during each stroke of the scissors.

Figure 13:
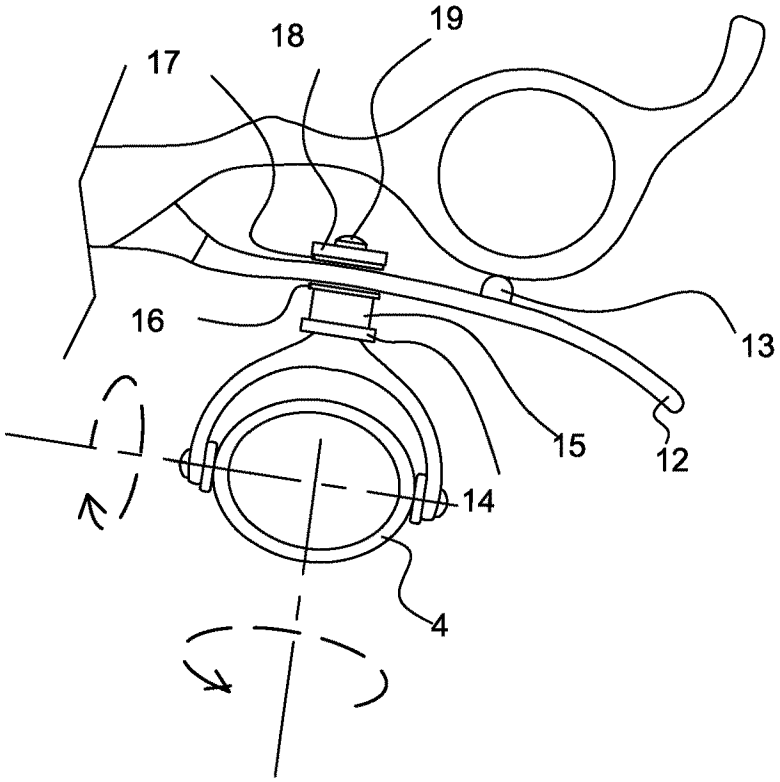
FIG. 13 is a side view of the first embodiment of the present invention that comprises a thumb ring capable of rotating along two perpendicular axes.

FIG. 13 is a side view of the first embodiment of the present invention that comprises a thumb ring capable of rotating along two perpendicular axes. The two axes of rotational movement are shown by the dashed arrows. Each direction of rotation is free to move during opening and closing of the blades during use. The dual-rotation thumb ring in FIG. 13 is preferred over the single-rotation thumb ring shown in FIG. 12 by some users and can be combined with any of the embodiments described herein.

FIG. 14 is a perspective view of the first embodiment of the present invention, illustrating relative orientation of the cutting blades and longitudinal slot on the thumb handle. Three dimensional axes are also shown in the figure and are labeled x, y and z. Referring to FIG. 14, the flat sides of the blade 35 lie in a vertical plane (the x-y plane), and the flat side of the thumb handle 12 lies in the x-z plane. The x-z plane is perpendicular to the plane of the flat side of the blades 35. These sliding surfaces are also perpendicular to the flat sides of the blades, as shown in the figure. By contrast, the sliding surfaces of Yusufov (U.S. Pat. No. 6,915,578) are in the same plane as the flat sides of the blades. By orienting the sliding surfaces so they are perpendicular to the flat sides of the blades rather than in the same plane as the flat sides of the blade blades, the thumb ring 4 of the present invention can be more properly positioned to reduce strain on the user's thumb, thereby reducing fatigue and the risk of repetitive-motion injury.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

The invention claimed is:

1. A pair of scissors comprising:

(a) a first cutting blade comprising a thumb handle having a substantially flat upper surface and a substantially flat lower surface and a thumb ring;

(b) a second cutting blade comprising a second handle having a finger ring, wherein the second cutting blade is pivotally attached to the first cutting blade, and wherein the first and second cutting blades pivot relative to one another within a first plane that is defined by a first axis and a second axis, the thumb handle substantially flat when compared to the second handle;

wherein the thumb ring is slidably and rotatably attached to the first cutting blade by a shaft having at least a threaded portion, the shaft moves freely but with a certain amount of friction along a longitudinal slot in the thumb handle of the first cutting blade when the scissors are used to cut, a magnet disposed on the shaft adjacent the thumb ring, a lower slide washer disposed on the shaft between the magnet and the substantially flat lower surface of the thumb handle, and an upper slide washer disposed on the shaft adjacent the substantially flat upper surface of the thumb handle and the thumb ring rotates on one end of the shaft; and wherein the longitudinal slot in the thumb handle is situated within a second plane that is defined by the first axis and a third axis and by the substantially flat upper surface of the thumb handle and the substantially flat lower surface of the thumb handle, the second plane perpendicular to the first plane, the shaft perpendicular to the second plane, the thumb ring rotating on the one end of the shaft.

2. The pair of scissors of claim 1, wherein a bumper is disposed at one end of said longitudinal slot.

* * * * *